US012104454B2

(12) United States Patent
Brewer et al.

(10) Patent No.: US 12,104,454 B2
(45) Date of Patent: Oct. 1, 2024

(54) FLOW RESTRICTOR METHOD AND APPARATUS

(71) Applicant: Epic Lift Systems, Houston, TX (US)

(72) Inventors: Daniel Brewer, Fort Worth, TX (US); Patrick R. McCarthy, Springtown, TX (US)

(73) Assignee: Epic Lift Systems, Houston, TX (US)

( * ) Notice: Subject to any disclaimer, the term of this patent is extended or adjusted under 35 U.S.C. 154(b) by 166 days.

(21) Appl. No.: 17/726,066

(22) Filed: Apr. 21, 2022

(65) Prior Publication Data

US 2022/0349280 A1 Nov. 3, 2022

Related U.S. Application Data

(60) Provisional application No. 63/182,554, filed on Apr. 30, 2021.

(51) Int. Cl.

| | |
|---|---|
| ***E21B 34/02*** | (2006.01) |
| ***E21B 33/068*** | (2006.01) |
| ***E21B 43/12*** | (2006.01) |
| ***F04B 47/12*** | (2006.01) |

(52) U.S. Cl.

CPC ..... *E21B 34/025* (2020.05); *E21B 33/068* (2013.01); *E21B 43/121* (2013.01); *F04B 47/12* (2013.01)

(58) Field of Classification Search

CPC ..... E21B 43/121; E21B 43/12; E21B 34/02; E21B 34/025; E21B 33/068; F04B 47/12

See application file for complete search history.

(56) References Cited

U.S. PATENT DOCUMENTS

| | | | | |
|---|---|---|---|---|
| 2,884,861 | A | 4/1957 | Vincent et al. | |
| 4,923,372 | A | 5/1990 | Ferguson et al. | |
| 6,851,480 | B2 | 2/2005 | Swoyer et al. | |
| 7,337,854 | B2 | 3/2008 | Horn et al. | |
| 7,445,048 | B2 | 11/2008 | Sheffield | |
| 9,850,731 | B2 | 12/2017 | Maerz et al. | |
| 11,208,874 | B2 | 12/2021 | Murdoch et al. | |
| 11,851,980 | B2 | 12/2023 | Freeman | |
| 2006/0231149 | A1* | 10/2006 | Kulkarni | G01F 1/42 138/44 |
| 2015/0369022 | A1* | 12/2015 | Zhou | E21B 7/061 166/50 |
| 2017/0254787 | A1* | 9/2017 | Campanella | E21B 49/08 |
| 2019/0234191 | A1* | 8/2019 | Murdoch | E21B 43/12 |

* cited by examiner

*Primary Examiner* — George S Gray

(74) *Attorney, Agent, or Firm* — Park, Vaughan, Fleming & Dowler LLP

(57) ABSTRACT

The invention relates to systems and apparatuses that include a manifold block. The manifold block includes a production line flow path and a flow path from a wellhead to a lubricator. The manifold block further includes an insert region configured to receive a removable flow restrictor wherein the insert region is separate from the production line flow path and the flow path from the wellhead to the lubricator.

18 Claims, 15 Drawing Sheets

FLOW RESTRICTOR METHOD AND APPARATUS

PRIORITY CLAIM

This application claims priority to provisional patent application Ser. No. 63/182,554 filed Apr. 30, 2021, which is fully incorporated herein by reference.

TECHNICAL FIELD OF THE INVENTION

Embodiments of the subject matter disclosed herein relate to an improved flow restrictor assembly, and methods of operating and using the same.

DISCUSSION OF THE BACKGROUND

It is well known that production from oil and gas wells requires the diversion of produced materials at the wellhead. Various methods and devices have been developed for that purpose. The present invention assists in that process by providing a new manifold block with a removable orifice that overcomes prior art problems associated with such manifold blocks and the replacement of such orifices.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are embodiments of systems and apparatuses that include a flow restrictor method and apparatus. In an embodiment, a lubricator is coupled to a manifold block. As those skilled in the art will appreciate, often it is desirable to control the flow of gas and/or liquids from a well as they enter the manifold block and otherwise flow through the lubricator. In an embodiment of the present invention, the manifold block is provided with an orifice plate (or other restrictor pin) that controls the rate of flow from the well through the manifold block and, accordingly, throughout the lubricator coupled thereto. As described in more detail in the detailed description of the invention, the manifold block is designed to permit the insertion and removal of the orifice plate (or flow restrictor device) that is safer, easier, and less time consuming to insert and/or remove than prior art systems for controlling production flow through a manifold block and lubricator. Moreover, the disclosed design will accommodate orifice plates (and other restrictor devices) of varying sizes that variously affect the rate of production flow through a manifold block and/or lubricator.

BRIEF DESCRIPTION OF THE DRAWINGS

The disclosure may be understood by reference to the following description taken in conjunction with the accompanying drawings, in which like reference numerals identify like elements, and in which.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meeting, i.e., a meaning other than that understood by skilled artisans, such a special definition will be expressly set forth in the specification in a definitional manner that directly and unequivocally provides the special definition for the term or phrase.

Figure 1:
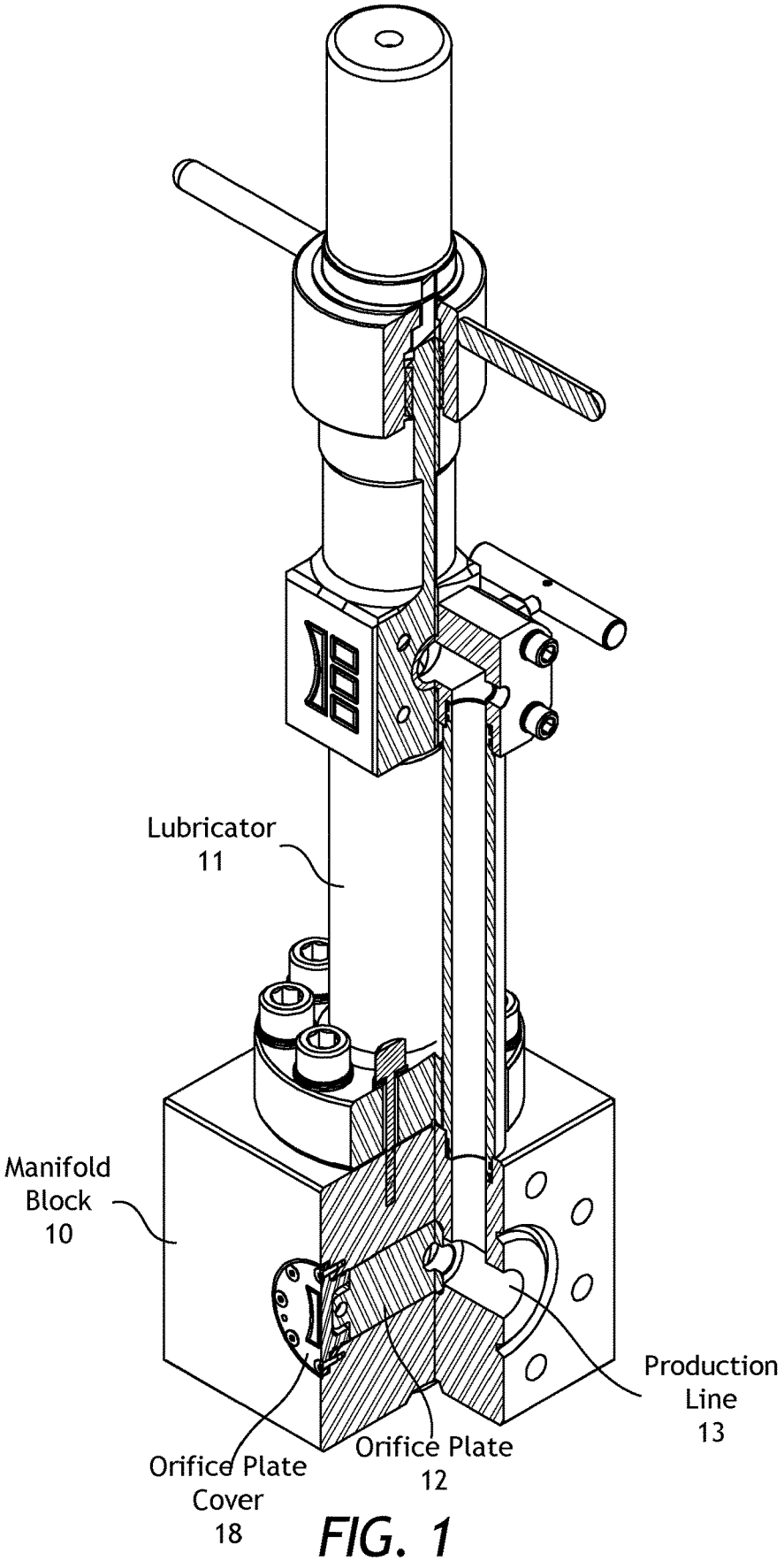
FIG. 1 is a partial perspective view of a manifold block and lubricator partially cut away to illustrate aspects of the orifice plate, its location, and orientation.

The present embodiments describe a flow restrictor method and apparatus. FIG. 1 is a partial perspective view of an exemplary manifold block 10 and exemplary lubricator 11, where both manifold block 10 and lubricator 11 have been partially cut away to illustrate aspects of exemplary orifice plate 12, including its location and orientation. Those skilled in the art will be familiar with lubricators and manifold blocks. Here, production line 13 is visible, whereas the bore (in manifold block 10) that connects to the wellhead is not visible (but see FIG. 3 for the connection to the wellhead). Note that the location on the manifold block for inserting orifice place 12 is offset toward production line 13 so that the orifice plate does not directly restrict the flow from the well into the lubricator, but rather it restricts (as explained in more detail below) the flow from the well into the production line. As those skilled in the art will appreciate, there can be a variety of reasons for restricting well production from immediately entering the production line, including at least ensuring sufficient flow into the lubricator so as to hold or maintain (via the flow of the well itself) a plunger or other artificial lift device in the lubricator. In that regard, FIG. 1 also shows production flow being routed from the top of lubricator 11 back down to production line 13. Other lubricator designs are specifically contemplated and are within the spirit and scope of the present invention.

Figure 2:
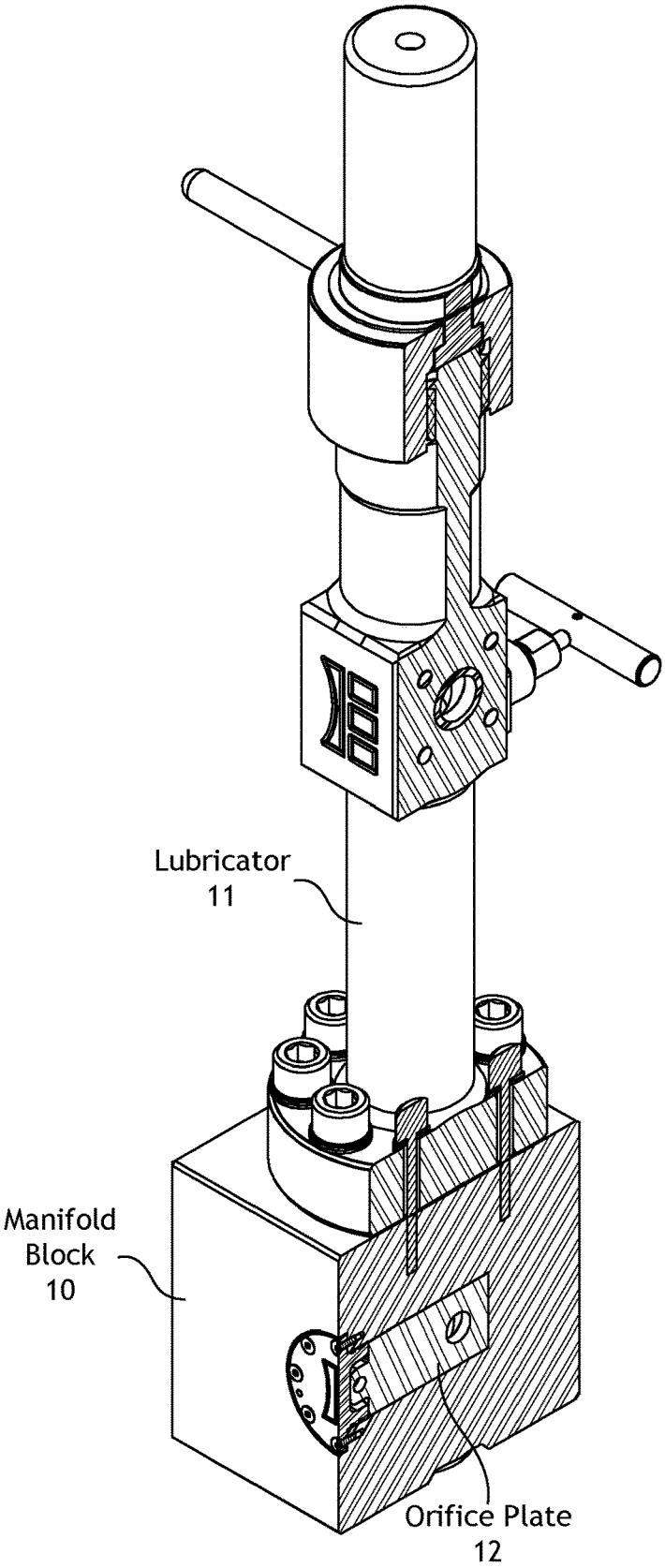
FIG. 2 is a partial perspective view of a manifold block and lubricator partially cut away to illustrate aspects of the orifice plate, its location, and orientation.

FIG. 2 is another partial perspective view of manifold block 10 and lubricator 11 partially cut away to illustrate aspects of orifice plate 12, its location, and orientation. Here, the cut away is again through orifice plate 12 to better illustrate that it is located in production line 13 so as to not directly interfere with production from the wellhead into lubricator 11 (i.e., in this embodiment it is not positioned in bore leading directly from the wellhead to the lubricator).

Figure 3:
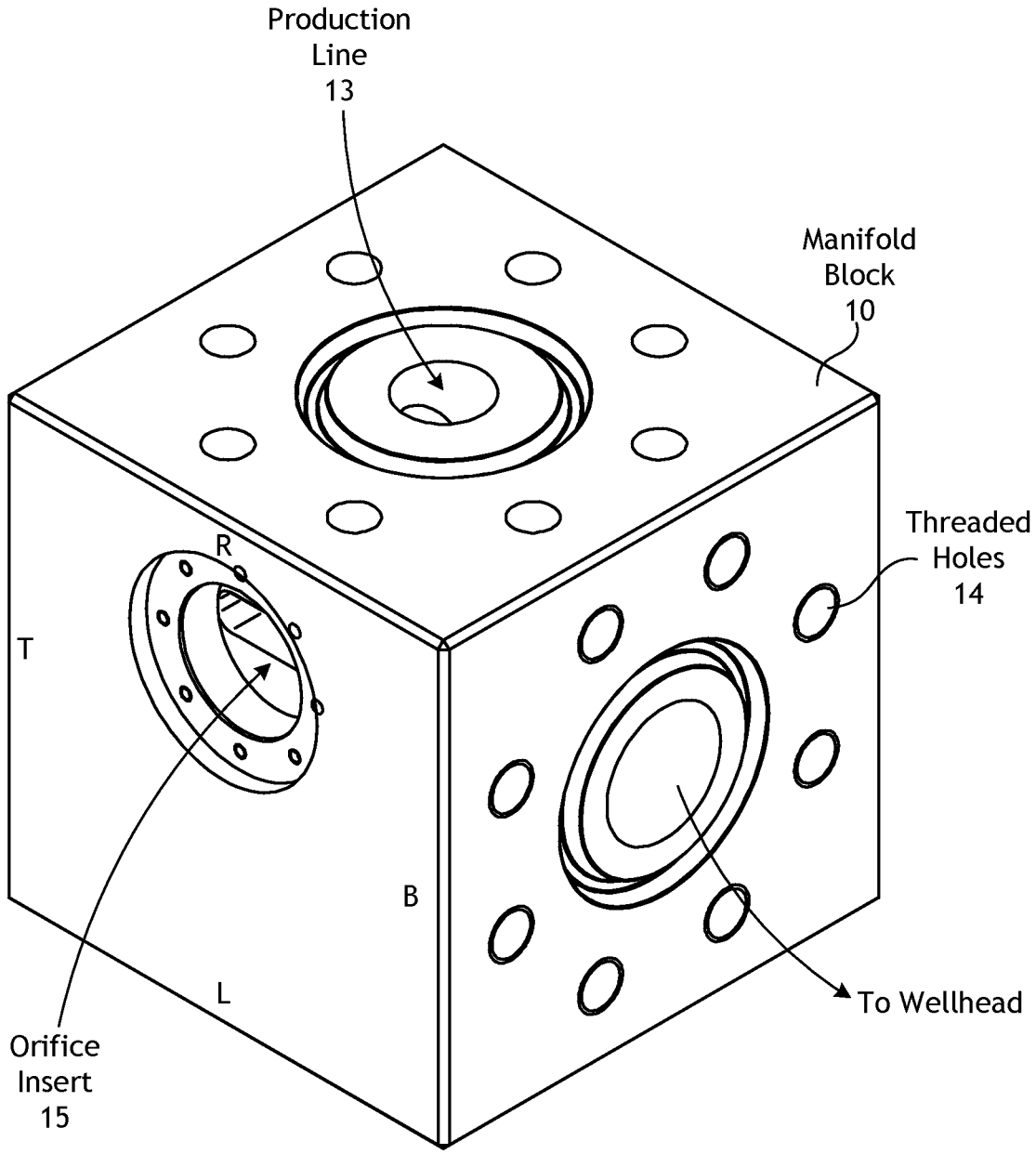
FIG. 3 is a perspective view of a manifold block.

FIG. 3 is a perspective view of manifold block 10. Once again visible is the bore/connection to production line 13 and orifice insert 15. The bore/connection to the wellhead is also shown. Once again, note that the location on the manifold block of orifice insert 15 is offset toward production line 13 so that orifice plate 12 does not directly restrict the flow from the well into the lubricator, but rather it restricts the flow from the wellhead into the production line. Threaded holes 14 are illustrated to show the locations where flange connections can be made at the wellhead and production line. Those skilled in the art will appreciate that other suitable mechanisms for making a connection to the manifold block are known and within the scope and spirit of the present invention.

Figure 4:
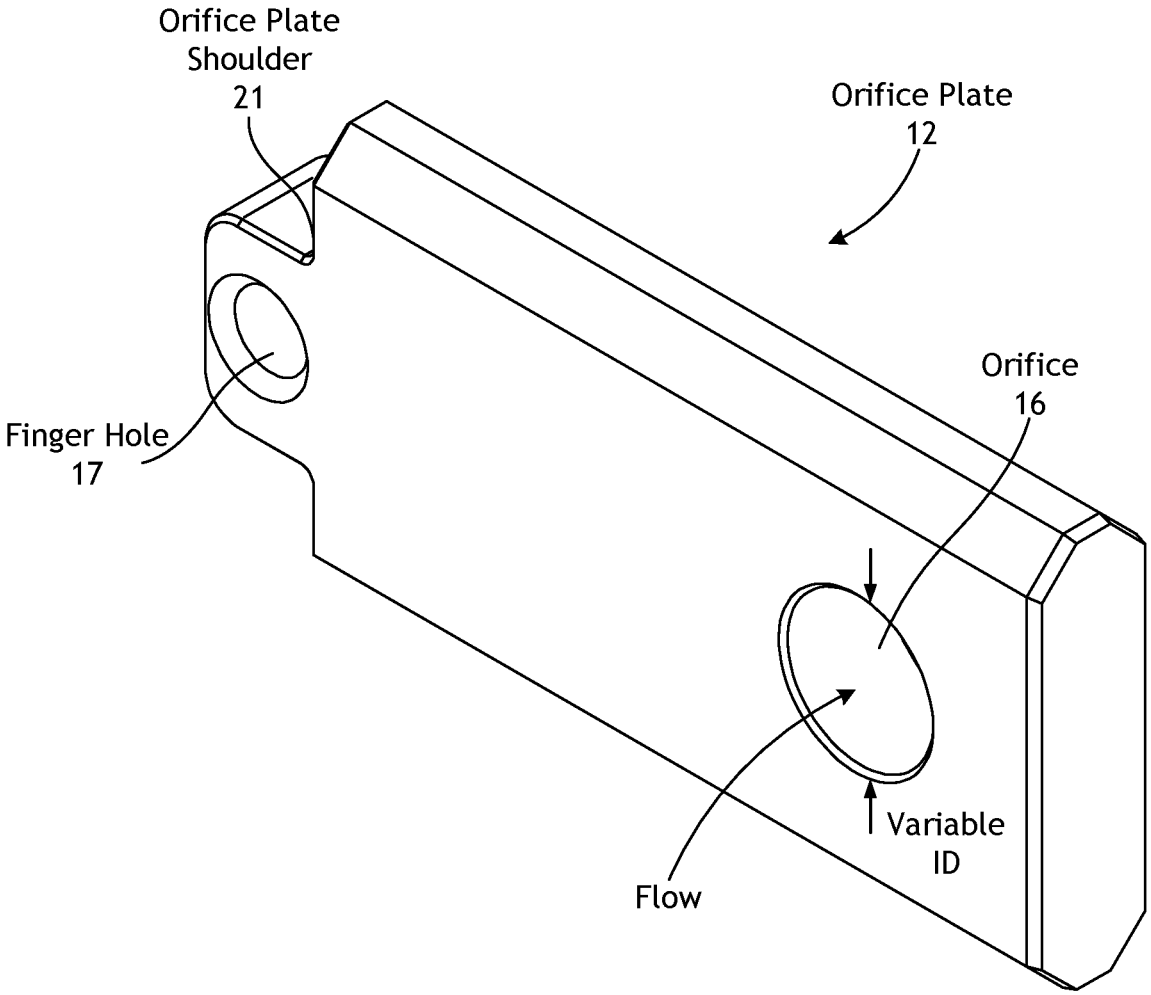
FIG. 4 is a perspective view of an orifice plate.

FIG. 4 is a perspective view of an exemplary embodiment of orifice plate 12. As the embodiment shows, orifice plate 12 includes orifice 16, which is illustrated as having a variable diameter. The variable diameter notation is intended to mean that one orifice plate 12 can have an orifice 16 of one diameter, whereas another orifice plate 12 can have an orifice 16 of another diameter. It also contemplates a single orifice plate 12 that includes an orifice 16 that can be adjusted so as to have a larger or smaller diameter orifice 16. As those skilled in the art will appreciate, an orifice with a smaller diameter will allow less production (from the wellhead) into production line 13 (thereby forcing more production into lubricator 11), whereas an orifice with a larger diameter will allow more production (from the wellhead) into production line 13 (thereby reducing production flow into lubricator 11).

FIG. 4 also shows orifice plate 12 including finger hole 17. Finger hole 17 is sized so that a user's finger can be inserted in finger hole 17 to facilitate inserting and removing orifice plate 12 from manifold block 10. As shown and described in more detail below in connection with FIGS. 13-15, those skilled in the art will further appreciate that orifice plate 12 need not assume the geometric shape (or even include an orifice 16) described in FIG. 4, nor is finger hole 17 necessary. Instead, orifice plate 12 can assume any geometric shape suitable for reducing flow in production line 13.

Figure 5:
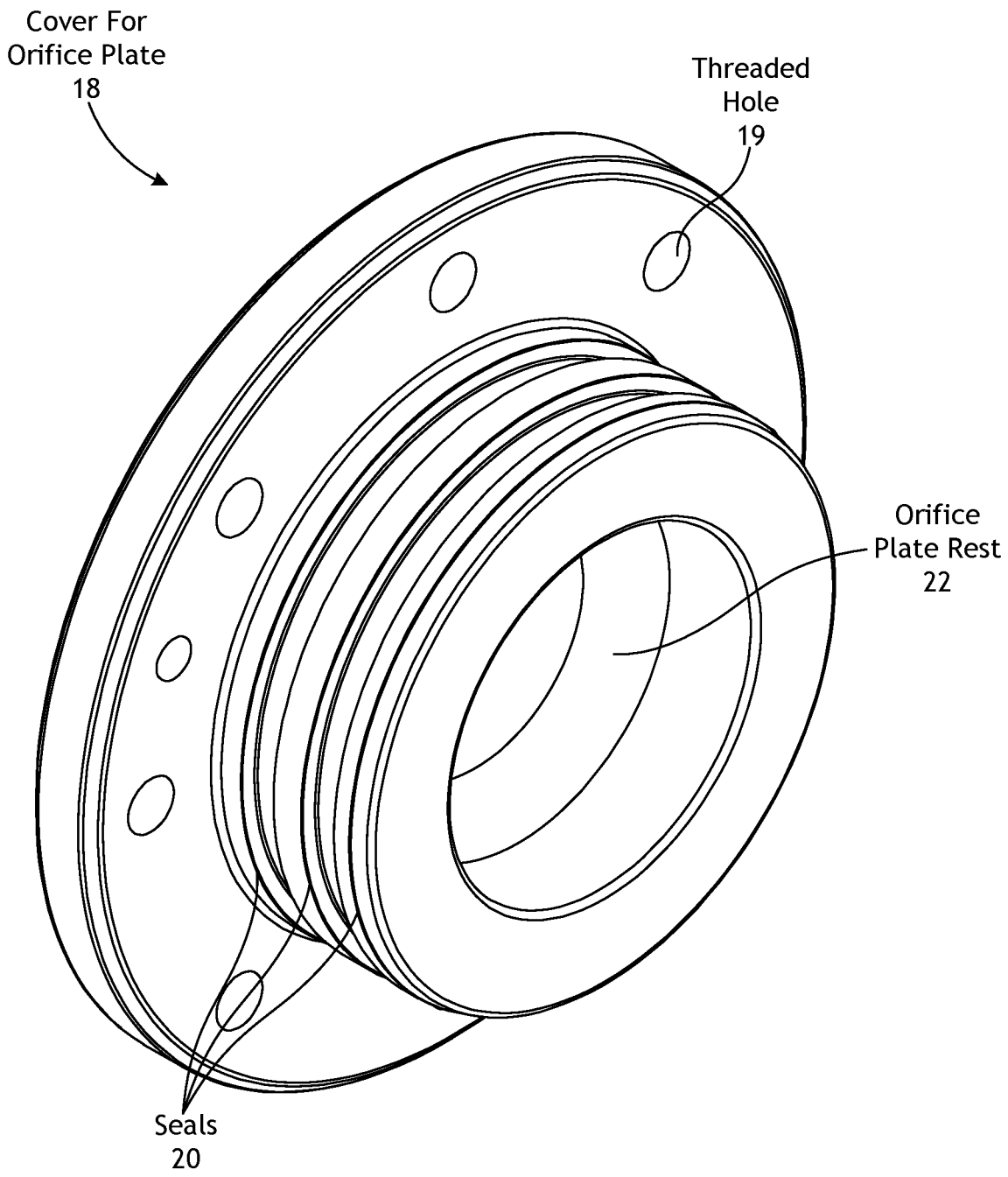
FIG. 5 is a perspective view of an orifice plate cover.

FIG. 5 is a perspective view of orifice plate cover 18. A portion of orifice plate cover 18 also is shown in FIG. 1. Orifice plate cover 18 functions as its name implies—it covers and maintains orifice plate 12 in position in manifold block 10. As shown, orifice plate cover 18 is illustrated as being mounted to manifold block 10 using threaded holes 19, through which bolts can pass to securely hold orifice plate cover 18 to manifold block 10. As those skilled in the art will appreciate, other equally suitable mechanisms can be used to attach orifice plate cover 18 to manifold block 10. FIG. 5 also shows seals 20, which serve to make the interface between orifice plate cover 18 and manifold block 10 substantially airtight.

Finally, FIG. 5 also shows orifice plate rest 22. Orifice plate rest 22 is shaped to receive orifice plate shoulder 21 (shown in FIG. 4). In other words, orifice plate shoulder 21 and the difference between the outside diameter and inside diameter of orifice plate rest 22 are substantially the same so that substantially all of orifice plate shoulder 21 rests on (or is in contact with) orifice plate rest 22. (See also FIG. 8.) As such, the facing edge of finger hole 17 is seen when viewing orifice plate cover 18 as it is installed on manifold block 10 (see also FIG. 1).

Those skilled in the art will recognize that, as with the geometric shape of orifice plate 12, the geometric shape of orifice plate cover 18 is optional so long as the chosen shape effectively maintains orifice plate 12 in manifold block 10. Indeed, to the extent orifice plate 12 is shaped, or otherwise has the ability, to adequately maintain itself in manifold block 10, orifice plate 18 is optional to the present invention. (See FIGS. 9-15.)

Figure 6:
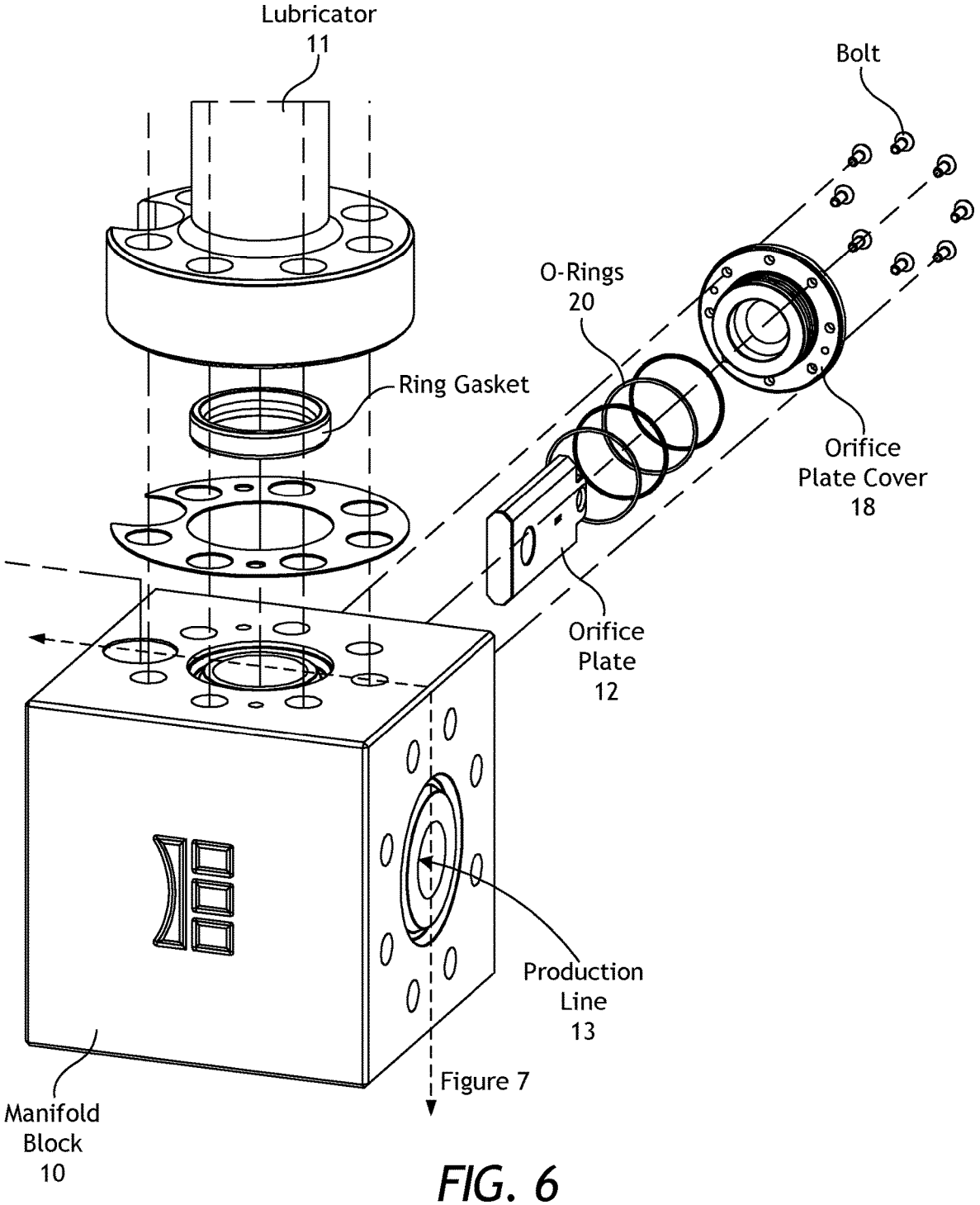
FIG. 6 is an assembly drawing of a manifold block, lubricator, orifice plate, and orifice plate cover, including additional associated components.

FIG. 6 is an assembly drawing of manifold block 10, lubricator 11, orifice plate 12, and orifice plate cover 18, including additional associated components as shown. As explained above and as shown by FIG. 6, lubricator 11 attaches to manifold block 10 to receive production flow from the wellhead. Additionally, orifice plate 12 is shown being inserted into orifice insert 15 in manifold block 10 and covered by orifice plate 18, which is bolted to manifold block 10 using a series of bolts. In that manner for this particular embodiment, orifice plate 12 is maintained in manifold block 10.

Figure 7:
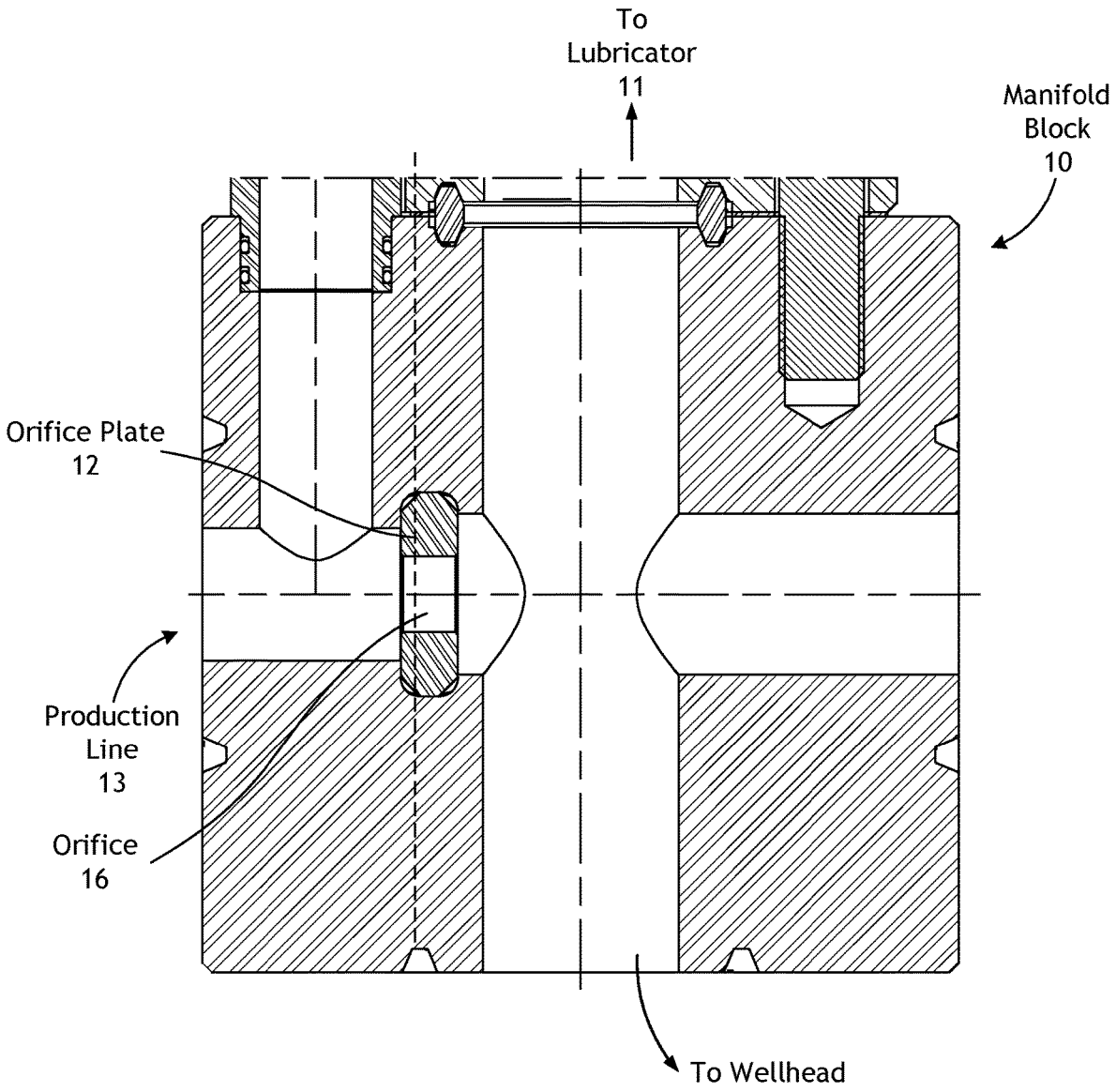
FIG. 7 is a cross section of a manifold block taken along the cross sectional line shown in FIG. 6.

FIG. 7 is a cross section of manifold block 10 taken along the cross section line shown in FIG. 6. FIG. 7 shows orifice place 12, orifice 16, and the flow paths to lubricator 11, production line 13, and the wellhead. As shown in this exemplary embodiment, orifice plate 12 traverses the flow path of production line 13 so that orifice 16 is centrally located therein and, thereby, controls the production flow into production line 13 from the wellhead.

Figure 8:
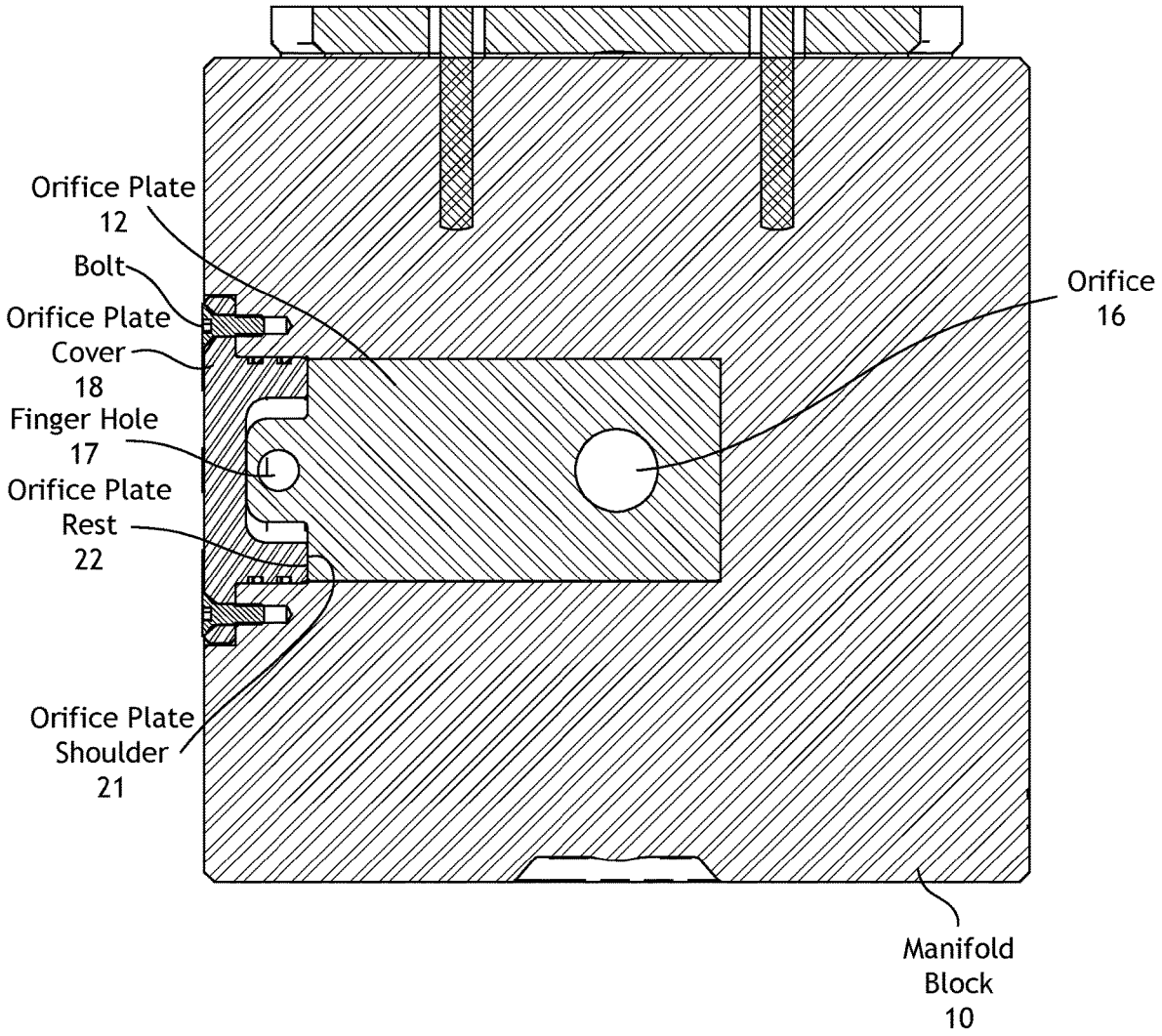
FIG. 8 is a cross section of a manifold block.

FIG. 8 is a cross section of manifold block 10 taken lengthwise through orifice plate 12. Shown in FIG. 8 are orifice plate 12, orifice 16, finger hole 17, orifice plate cover 18, orifice plate shoulder 21, orifice plate rest 22, and bolts for holding orifice plate cover 18 to manifold block 10. FIG. 8 better illustrates the positional relationship of orifice plate 12 in manifold block 10, including the relationship between orifice plate rest 22 and orifice plate shoulder 21. Neither the bore in manifold block 10 leading from the wellhead to lubricator 11, nor the production line 13, are visible since orifice plate 12 is offset in production line 13.

Figure 9:
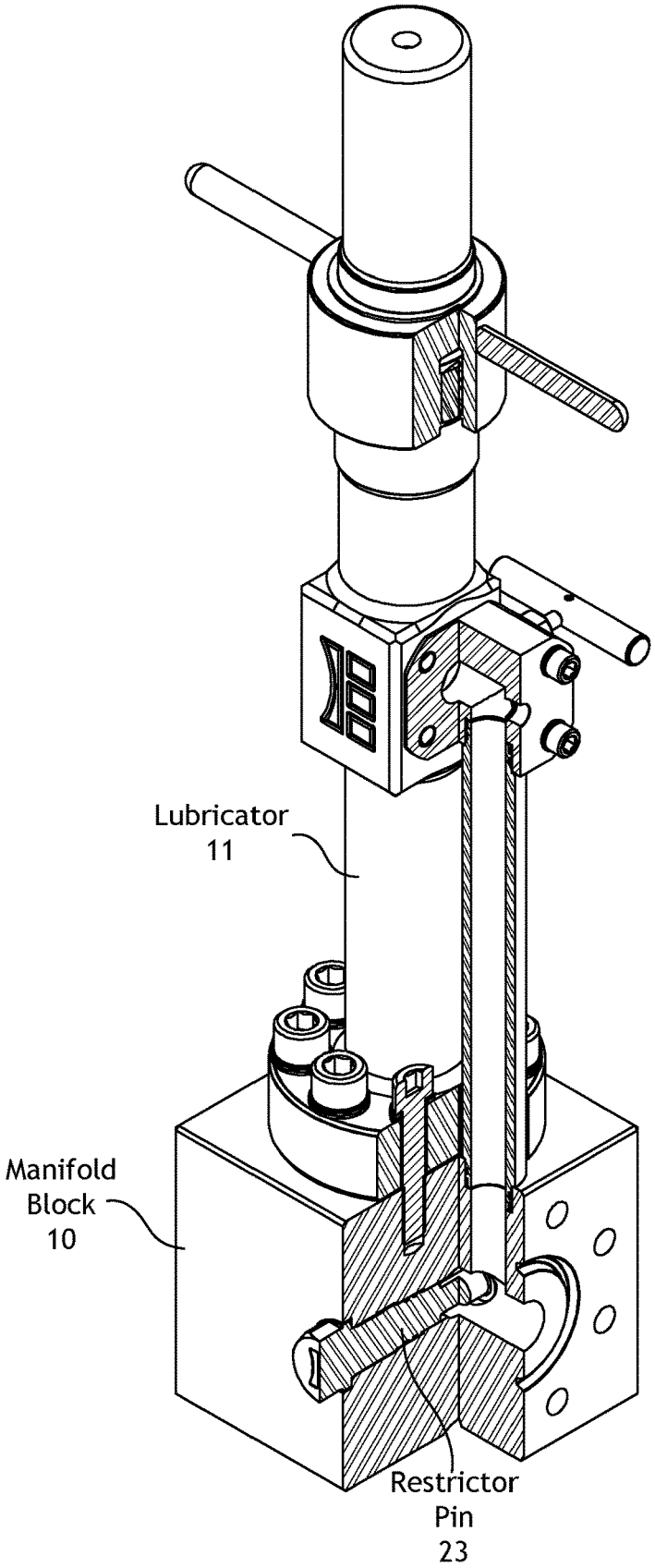
FIG. 9 is a partial perspective view of a manifold block and lubricator partially cut away to illustrate aspects of the restrictor pin, its location, and orientation.

FIG. 9 is a partial perspective view of another exemplary embodiment of manifold block 10 and lubricator 11 partially cut away to illustrate aspects of a restrictor pin 23, including the location and orientation of restrictor pin 23. The geometries and functions of the embodiment of FIG. 9 are similar to those of FIGS. 1-8, except here restrictor pin 23 replaces the functionality of orifice plate 12. The following Figures further illustrate these aspects of the present invention.

Figure 10:
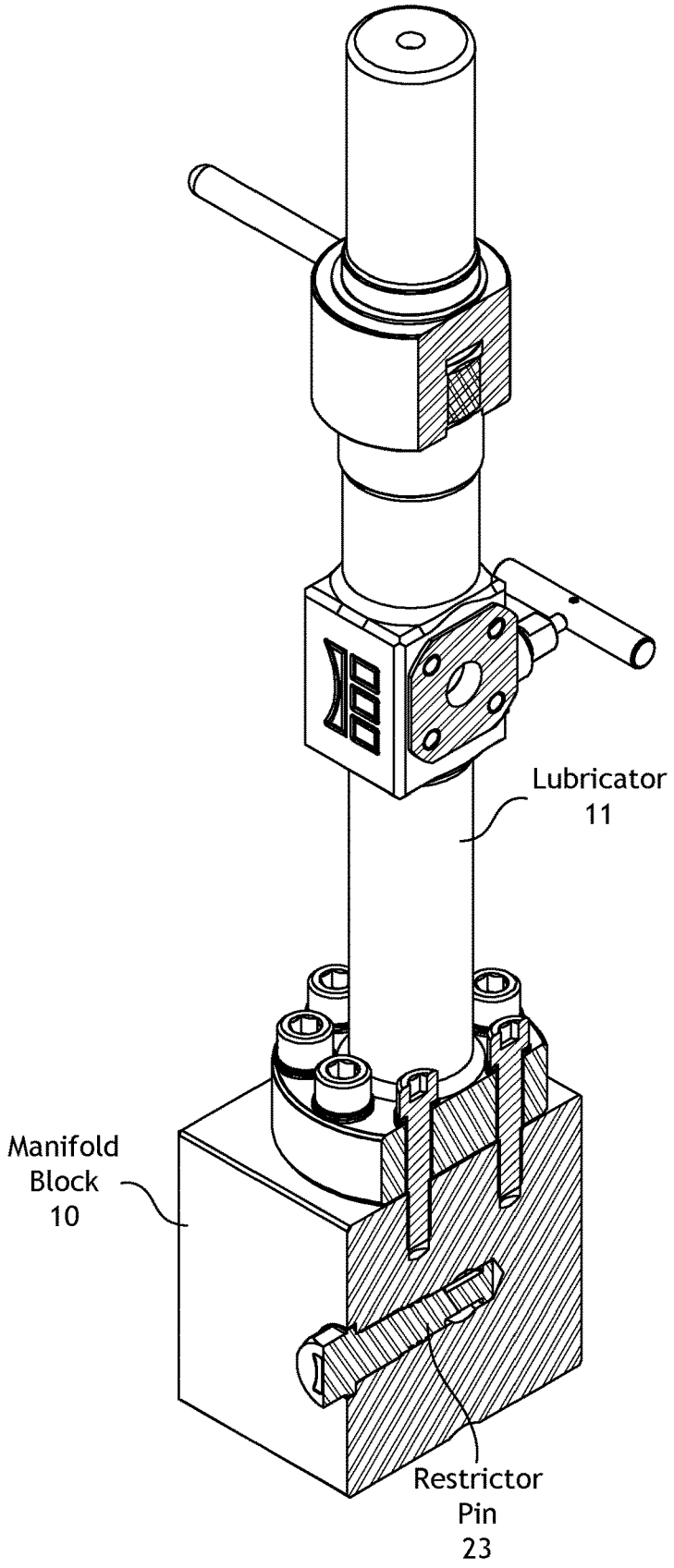
FIG. 10 is a partial perspective view of a manifold block and lubricator partially cut away to illustrate aspects of the restrictor pin, its location, and orientation.
Figure 11:
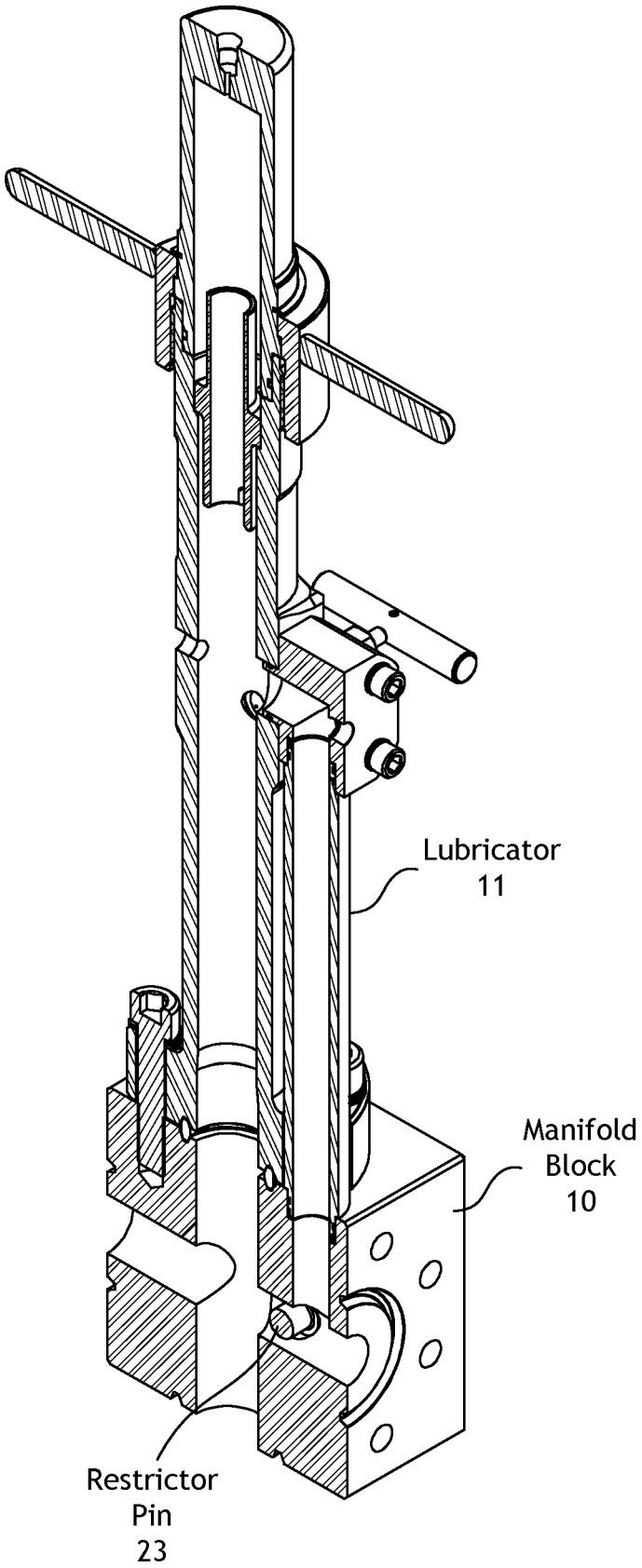
FIG. 11 is a partial perspective view of a manifold block and lubricator partially cut away to illustrate aspects of the restrictor pin, its location, and orientation.

FIGS. 10-11 are additional partial perspective views of manifold block 10 and lubricator 11 partially cut away to illustrate aspects of restrictor pin 23, its location, and orientation. In each Figure, the cut away is again through restrictor pin 23 (albeit in different directions) to better illustrate where and how restrictor pin 23 is located in production line 13 so as to not directly interfere with production from the wellhead into lubricator 11.

Figure 12:
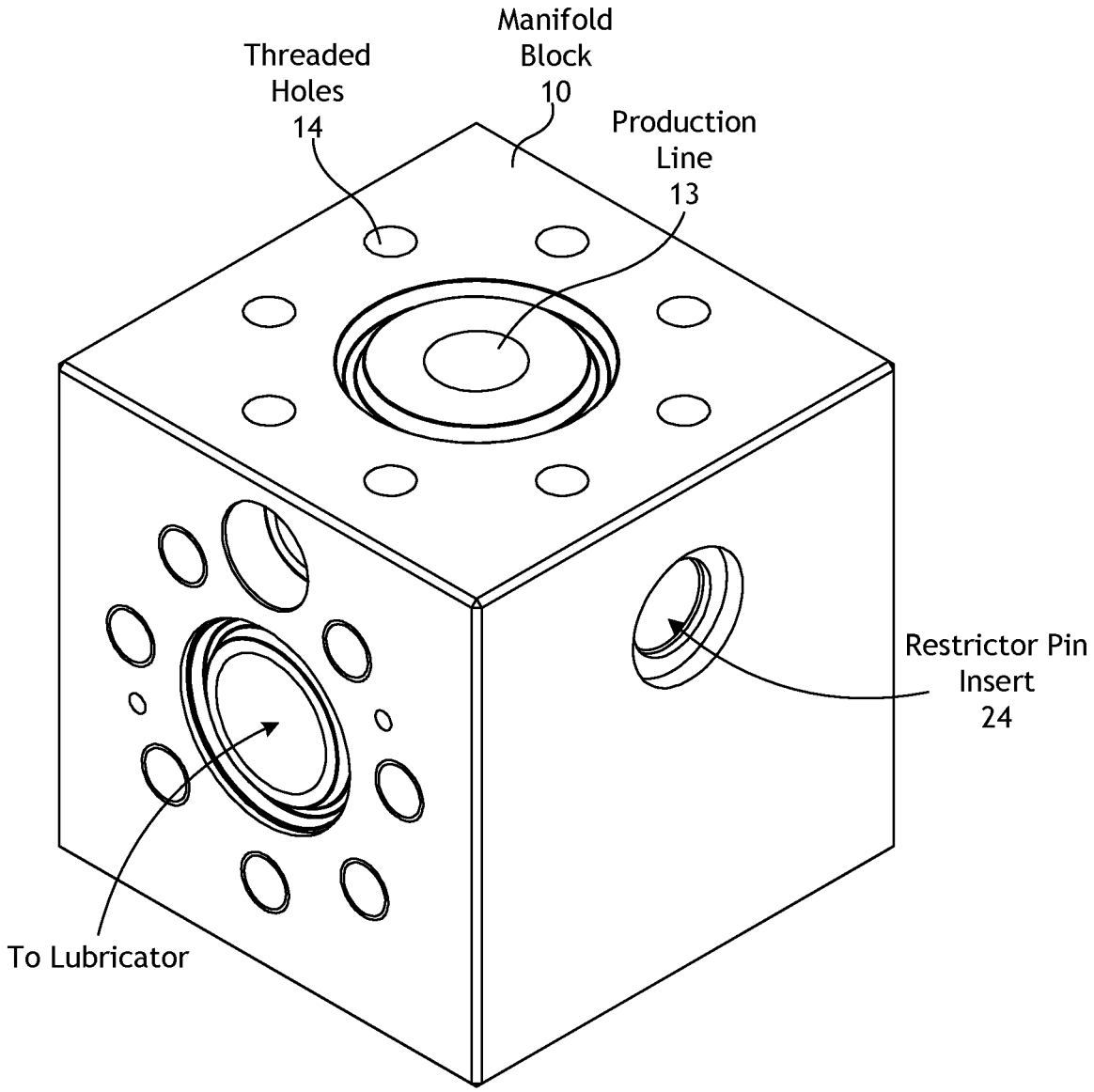
FIG. 12 is a perspective view of a manifold block.

FIG. 12 is a perspective view of an embodiment of manifold block 10. Once again visible is the bore/connection to production line 13 and restrictor pin insert 24. The bore/connection to lubricator 11 is shown, but the bore/connection to the wellhead is not. Note that the location on the manifold block of restrictor pin insert 24 is offset toward production line 13 so that restrictor pin 23 does not directly restrict the flow from the well into the lubricator, but rather it restricts the flow from the wellhead into the production line. Threaded holes 14 are illustrated to show the locations where flange connections can be made at the production line and lubricator. Those skilled in the art will appreciate that other suitable mechanisms for making a connection to the manifold block are known and within the scope and spirit of the present invention.

Figure 13:
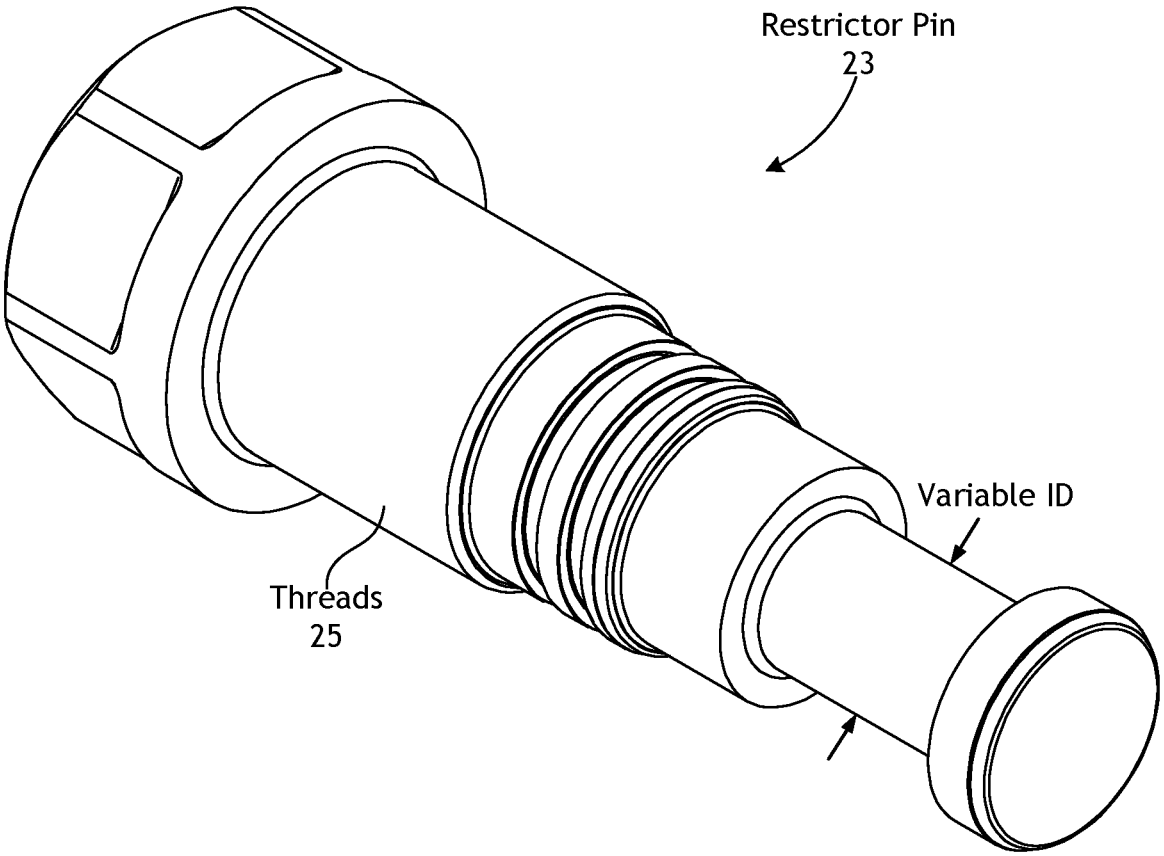
FIG. 13 is a perspective view of a restrictor pin.

FIG. 13 is a perspective view of an exemplary embodiment of restrictor pin 23. As shown, restrictor pin 23 includes a variable diameter portion toward one end. The variable diameter notation is intended to mean that one restrictor pin 23 can have one diameter in that region, whereas another restrictor pin 23 can have another diameter in the same region. As those skilled in the art will appreciate, a restrictor pin with a smaller diameter will allow more production (from the wellhead) into production line 13 (thereby reducing production flow into lubricator 11), whereas a restrictor pin with a larger diameter will reduce production (from the wellhead) into production line 13 (thereby forcing more production into lubricator 11).

FIG. 13 also shows threads 25 on restrictor pin 23, which operate to hold restrictor pin 23 in manifold block 10. Those skilled in the art will appreciate that other mechanisms for maintaining restrictor pin 23 in manifold block 10 are known and are within the spirit and scope of the present invention. Moreover, as shown and described in connection with each of the foregoing Figures, those skilled in the art will further appreciate that restrictor pin 23 need not assume the geometric shape described in FIG. 13. Instead, like orifice plate 12, restrictor pin 23 can assume any geometric shape suitable for reducing flow in production line 13.

Figure 14:
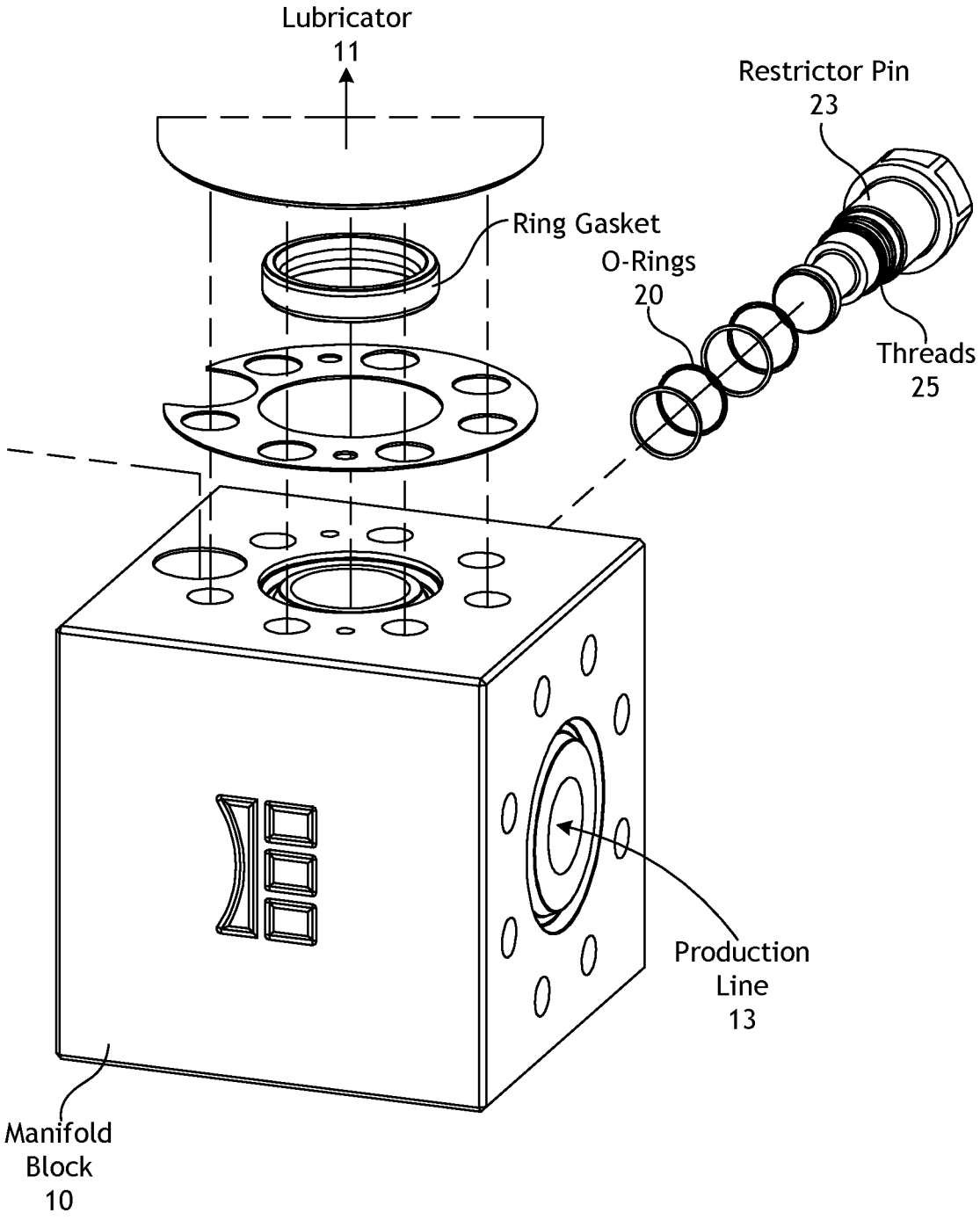
FIG. 14 is an assemble drawing of a manifold block, lubricator, and restrictor pin, including additional associated components.

FIG. 14 is an assembly drawing of manifold block 10, lubricator 11, and restrictor pin 23, including additional associated components as shown. As explained above and as shown by FIG. 14, lubricator 11 attaches to manifold block 10 to receive production flow from the wellhead. Additionally, restrictor pin 23 is shown being inserted into restrictor pin insert 24 in manifold block 10, which is maintained in manifold block 10 by threads 25. As can be seen, one advantage to restrictor pin 23 over the described embodiment of orifice plate 12 is that no orifice plate cover 18 (or its equivalent) is necessary in this particular embodiment.

Figure 15:
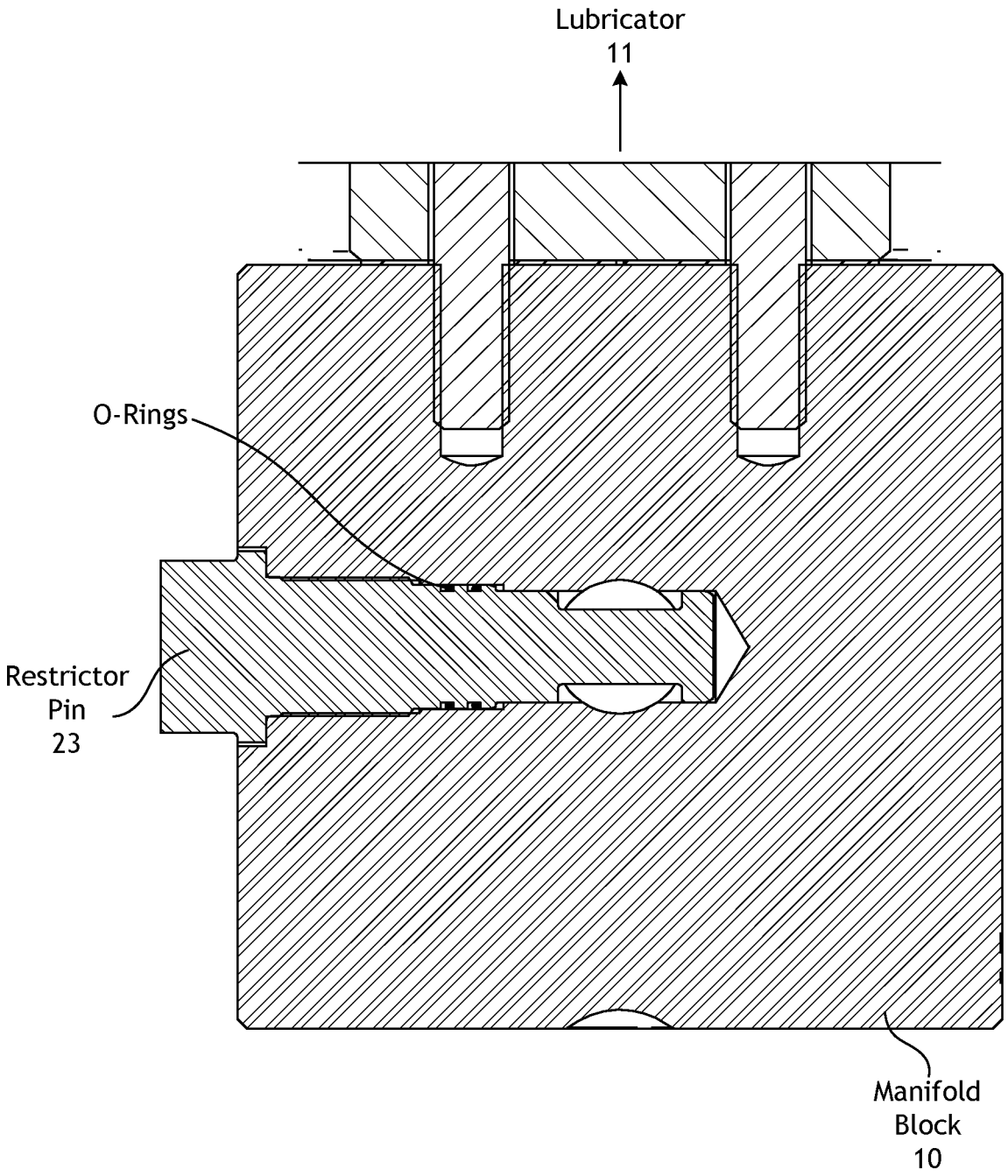
FIG. 15 is a cross section of a manifold block.

FIG. 15 is a cross section of manifold block 10 taken lengthwise through restrictor pin 23. FIG. 15 better illustrates the positional relationship of restrictor pin 23 in manifold block 10. The bore in manifold block 10 leading from the wellhead to lubricator 11 is not visible since restrictor pin 23 is offset in production line 13. Only a portion of production line 13 is visible since the variable diameter portion of restrictor pin 23 consumes most of the production line in this particular embodiment.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. An apparatus, comprising:

a manifold block having a production line flow path and a wellhead-to-lubricator flow path;

a removable flow restrictor at least partially located in the production line flow path; and an insert region on an exterior of the manifold block through which the removable flow restrictor can be inserted and removed.

2. The apparatus of claim 1 wherein the insert region on an exterior of the manifold block is separate from the production line flow path.

3. The apparatus of claim 2 wherein the insert region on an exterior of the manifold block is separate from the wellhead-to-lubricator flow path.

4. The apparatus of claim 3 wherein the removable flow restrictor is a restrictor pin.

5. The apparatus of claim 4 wherein the restrictor pin includes a region of reduced diameter.

6. The apparatus of claim 5 wherein the region of reduced diameter is located at least partially in the production line flow path.

7. The apparatus of claim 4 wherein the wellhead-to lubricator flow path includes a lubricator for receiving a plunger.

8. The apparatus of claim 4 wherein the restrictor pin includes a region of constant diameter.

9. The apparatus of claim 8 wherein the region of constant diameter is located at least partially in the production line flow path.

10. The apparatus of claim 3 wherein the removable flow restrictor is an orifice plate.

11. The apparatus of claim 10 wherein the orifice plate includes an orifice at least partially located in the production line flow path.

12. The apparatus of claim 11 further comprising an orifice plate cover.

13. The apparatus of claim 12 wherein the orifice plate includes at least one orifice plate shoulder.

14. The apparatus of claim 13 wherein the orifice plate cover includes at least one orifice plate rest.

15. The apparatus of claim 14 configured so that the orifice plate cover maintains the orifice plate in the manifold block.

16. The apparatus of claim 15 wherein the orifice plate cover maintains the orifice plate in the manifold block at least through an interface between the orifice plate rest and the orifice plate shoulder.

17. The apparatus of claim 16 wherein the wellhead-to lubricator flow path includes a lubricator for receiving a plunger.

18. A manifold block, comprising:

a production line flow path and a wellhead-to-lubricator flow path;

an insert region on an exterior of the manifold block through which the removable flow restrictor can be inserted and removed, wherein the insert region is separate from the production line flow path and the wellhead-to-lubricator flow path.

* * * * *